United States Patent [19]

Biske

[11] 4,029,925

[45] June 14, 1977

[54] ELECTRIC SWITCH

[75] Inventor: James A. Biske, Sterling Heights, Mich.

[73] Assignee: General Motors Corporation, Detroit, Mich.

[22] Filed: Apr. 5, 1976

[21] Appl. No.: 673,637

[52] U.S. Cl. ..... 200/339

[51] Int. Cl.[2] ..... H01H 3/00

[58] Field of Search ..... 200/339, 340, 85 A

[56] References Cited

UNITED STATES PATENTS

| | | | |
|---|---|---|---|
| 3,103,570 | 9/1963 | Gibbs | 200/339 X |
| 3,403,237 | 9/1968 | Wysong | 200/339 X |
| 3,718,791 | 2/1973 | Szablowski | 200/85 A |

*Primary Examiner*—E. A. Goldberg
*Attorney, Agent, or Firm*—Robert M. Sigler

[57] ABSTRACT

Electric switch apparatus comprises a housing containing first and second pairs of contacts, the separate contacts of each pair being held normally open by resilient means locally deformable to allow separate engagement of either pair. A rocker member pivotably supported in the housing has a pair of legs, one extending toward one contact of each pair and effective to push that contact into engagement with the other contact of the pair against the bias of the resilient means as the rocker member is reciprocated to one of two extreme positions. The housing further contains a pair of spring detents, each comprising a metallic strip having one end fastened to the housing adjacent one of the legs and another end spaced from the housing for engagement with the adjacent leg as it moves away from its associated pair of contacts, to hold the rocker member in the position in which the other leg produces engagement of the other pair of contacts.

1 Claim, 6 Drawing Figures

ELECTRIC SWITCH

BACKGROUND OF THE INVENTION

This invention relates to low current rocker or toggle switches; and particularly such switches that are simple in design, easy and inexpensive to manufacture in mass production, and suitable for use in an electronic multiplexed electrical system in an automobile or consumer appliance. The switch apparatus of this invention provides particular advantages where a plurality of such switches are to be located in one common area such as an automobile instrument panel, since the structure of the switch of this invention allows the use of some common parts among all the switches.

The typical commercially available rocker or toggle switch is a self-contained, separate unit which includes a variety of small parts which provide for complexity in manufacturing and resulting high cost. An example is the type TP rocker button-actuated toggle switch available from the Microswitch Company, which uses a spring-loaded finger which slides across overcenter tangs on a contact blade. Other locking rocker switches have been proposed in the patents to Norden U.S. Pat. No. 3,471,670; Gibbs U.S. Pat. No. 3,103,570; Reiner U.S. Pat. No. 3,254,191 and Steiner U.S. Pat. No. 3,743,980; but these either have similar complexity themselves or offer other disadvantages for mass production in automotive use. In addition, none of these switches allow the sharing of parts in multiple switch assemblies.

In the patent to Teofil Szablowski U.S. Pat. No. 3,718,791, issued Feb. 27, 1973, a pressure actuated switch is disclosed in which a resilient foam pad is sandwiched between a pair of parallel flexible sheets carrying fork-like planar contact members stamped to form frusto-conical contacts. The resilient foam member has a plurality of openings through whic the frusto-conical contacts are engaged to close a circuit when pressure exerted on the flexible sheets causes the foam pad to be compressed.

The switch of this invention uses a contact stucture similar to that shown in the Szablowski patent, but modified to provide multiple separate circuits. Such a contact "package" is included in a housing having a front face in which one or more rocker members are pivotally mounted. Each rocker member has a pair of legs, each of which legs is capable of alternately compressing or releasing the contact package in the area of one pair of contacts to close or open a particular circuit. A spring detent fixed to the housing adjacent each leg engages that leg when it is withdrawn from the contact package to latch the rocker member in this position with its opposite leg causing engagement of a pair of contacts.

Further details and advantages of this invention will be apparent from the accompanying drawings and following description of a preferred embodiment.

DESCRIPTION OF THE PREFERRED EMBODIMENT

Figure 1:
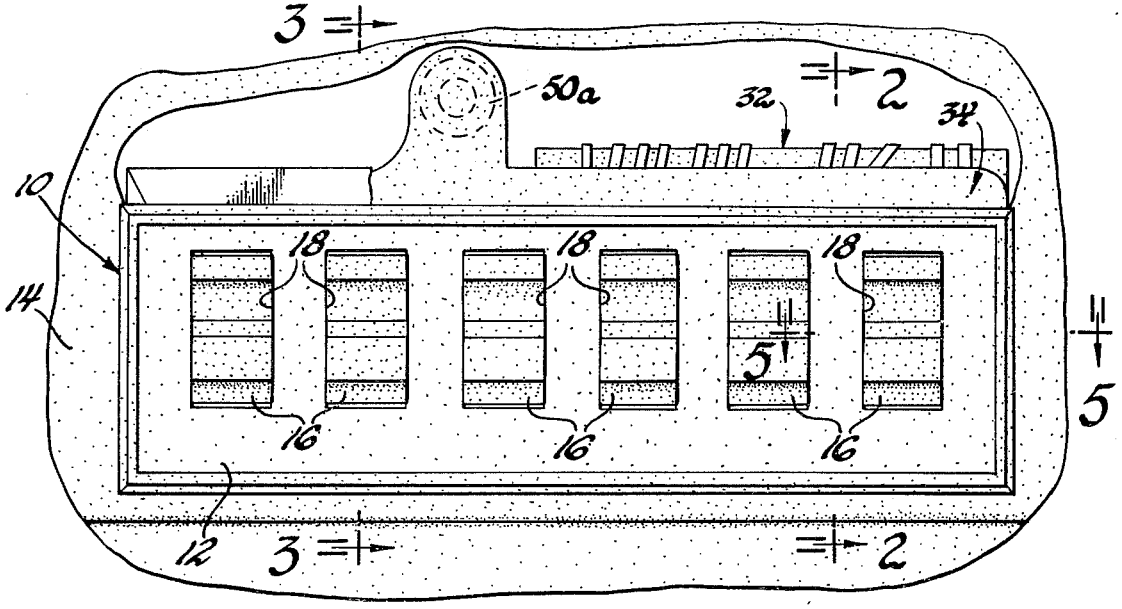
FIG. 1 shows a front view of a housing containing a plurality of switches according to this invention suitably arranged for use in an automobile instrument panel.

Referring to FIG. 1, a switch housing 10 having a face plate 12 is mounted in a desired location such as an automotive instrument panel 14. In the embodiment shown, six rocker members 16 are linearly arranged in openings 18 in face plate 12 for view of, and actuation by, a vehicle operator.

Figure 2:
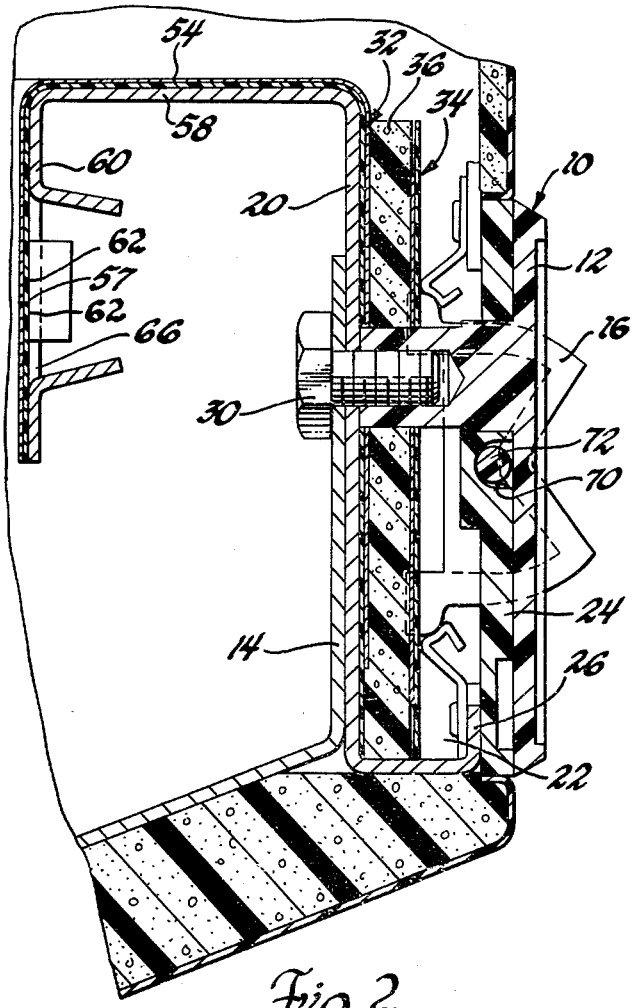
FIG. 2 is a section view along lines 2—2 in FIG. 1.
Figure 3:
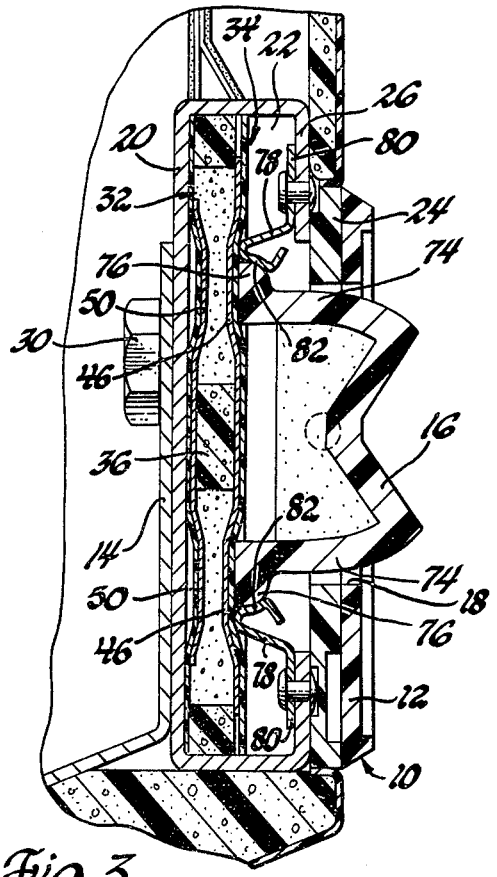
FIG. 3 is a section view along lines 3—3 in FIG. 1.
Figure 4:
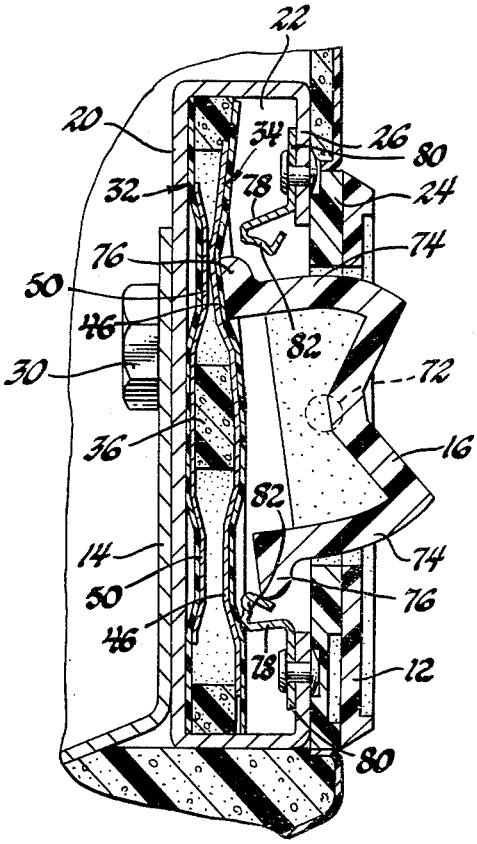
FIG. 4 is a view similar to FIG. 3 but showing the rocker member rotated into one of its contact closing positions.

Referring to FIGS. 2–4, housing 10 comprises a support plate 20 which backs against instrument panel 14 and is generally bent to define an inner rectangular volume 22, a backplate 24 pressed against bent-over tabs 26 of support plate 20, and a faceplate 12, which is pressed against backplate 24 and provided with, as shown in FIG. 2, one or more mounting studs projecting perpendicularly toward support plate 20 and instrument panel 14. Bolts 30 or similar fastening means, projecting through appropriate openings in instrument panel 14 and support plate 20, engage mounting studs 28 to hold support plate 20, backplate 24 and faceplate 12 together to form housing 10 and to attach housing 10 firmly to instrument panel 14.

The contact package is seen, in FIG. 2, to comprise a pair of planar members 32 and 34 sandwiching between them a resilient member 36. The contact package is supported within housing 10 with the planar member 32 fixed by adhesive or other means to support plate 20 within space 22 opposite backplate 24.

Figure 6:
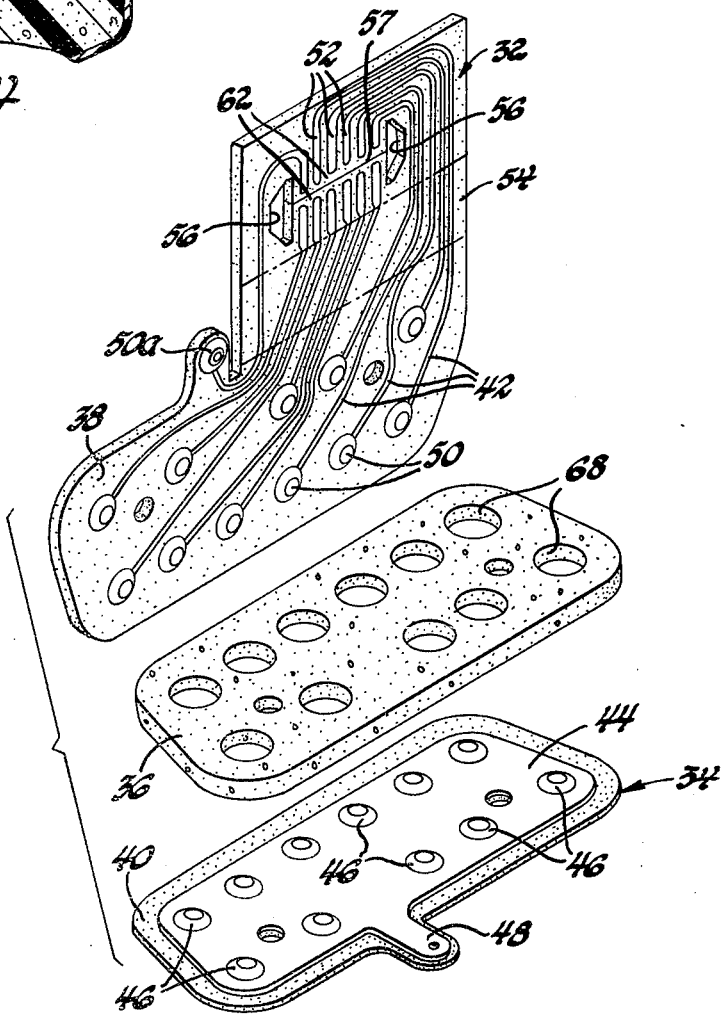
FIG. 6 is an exploded view of a contact package for use in the switch arrangement of FIG. 1.

In this embodiment, each of planar members 32 and 34 comprises an insulating support, 38 and 40, respectively, made of a generally flexible material such as thin polyester and one or more electrically conducting members 42, and 44, respectively, made from an electrically conducting metal foil and laminated to insulating supports 38 and 40, respectively. As seen in FIG. 6, conducting member 44 comprises, in this embodiment, a single sheet of copper film having formed therein a plurality of frusto-conical raised contacts 46 and including a planar projecting tab 48. Each of conducting members 42 comprises a raised frusto-conical contact 50 at one end and a planar contact 52 at the other. Each of contacts 50 except one, **50*a*, is disposed opposite one of the contacts 46 of conducting member 44. Contacting 50*a* is disposed opposite tab 48 and, as shown in FIGS. 1 and 3, is riveted or screwed thereto to provide an electrical connection therebetween. The planar contacts 52 are arranged as shown in FIG. 6 on an extension 54 of insulating support 38 having a pair of openings 56 joined by a slit 57. Referring to FIG. 2, extension 54 follows an extension 58 of support member 20, which ends in a plug support 60 behind instrument panel 14. Slit 57 joining openings 56 defines a pair of flexible tabs 62 in extension 54 which carry planar contacts 52. Flexible tabs 62 are adapted to be bent back by the insertion of a male electrical connector of well known design, not shown, into an opening 66 in plug support 60 and into engagement with planar contacts 52.**

In the arrangement shown, the planar contact 52 connected through contact **50*a* to conducting member 44 is adapted to be connected to a source of current at a first potential, such as the positive or ground terminal of a vehicle storage battery or alternator. The other planar contacts 52 are adapted to be connected to multiplexing apparatus, not shown, for the generation of actuation signals therefrom in response to the closing of appropriate contacts 50 and 46**.

Resilient member 36 comprises a locally compressible open cell polyurethane foam pad secured by a suitable adhesive to planar members 32 and 34. Openings 68 are provided in resilient member 36, one between each pair of contacts 50 and 46 to allow the engagement of said contacts; however, the dimensions of contacts 50 and 46 and the thickness of resilient member 36 are such as to normally maintain contacts 50 out of engagement with contacts 46. Since tab 48 and the portion of insulating support 38 carrying contact 50*a* project outward past the side of resilient member 36, no opening is required therefor.

Specific details of the materials and construction of the contact package described herein may be found in the previously cited patent to Szablowski U.S. Pat. No. 3,718,791. Of course, it should be obvious to a reader skilled in the art that the specific construction of the contact package need not be exactly as described in this embodiment of the Szablowski disclosure. For instance, planar member 32 is not required, in the switch of this invention, to flex or bend, except in the connector area of tabs 62; therefore it need not be similar in construction to planar member 34, but could comprise appropriate insulating and conducting coatings on support plate 20. In addition, contacts 46 do not need to be connected together through conducting member 34; nor do they need to be connected through tab 48 in contact 50*a* to a conducting member 42 in planar contact 52 in planar member 32. Alternatively, each of planar members 32 and 34 could be similar to planar member 32 in this embodiment with its own plug connector arrangement. The exact arrangement of contacts would depend on the requirements of the particular application.

Figure 5:
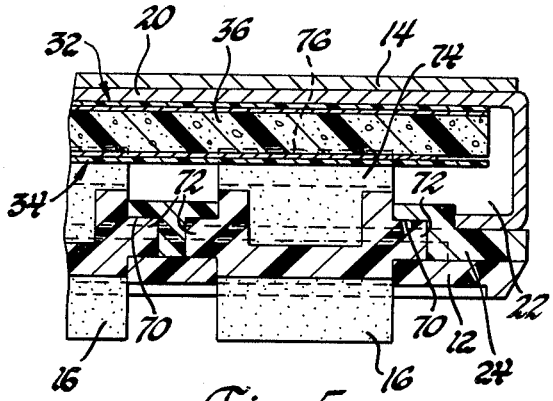
FIG. 5 is a section view along lines 5—5 in FIG. 1.

Referring to FIGS. 2 and 5, backplate 24 is provided with a plurality of depressions 70 flanking openings 18. Each rocker member 16 includes a pair of coaxial cylindrical pivots 72 disposed rotatably in depressions 70 and retained therein by faceplate 12. Pivots 72 allow each rocker member 16 to reciprocate about an axis.

Each rocker member 16 is provided with a pair of legs 74 extending into volume 22 away from faceplate 12 and toward planar member 34. Each leg 74 ends in a foot 76 adjacent one of the contacts 46 of planar member 34. FIG. 3 shows the rocker member 16 in a neutral lor unrotated position in which each foot 76 is immediately adjacent a contact 46, but neither of these contacts 46 is engaged with its respective contact 50. As shown in FIG. 4, however, rocker member 16 can be pivoted on pivot 72 to another position in which the upper foot 76 (in the Figure) presses its respective contact 46 into engagement with the respective contact 50 against the resilient bias of resilient member 36. In this position, the opposite foot 76 is moved away from contact 46 toward faceplate 12. There is a third position, not shown, which is just the opposite of that shown in FIG. 4: with the lower foot 76 (in the Figure) pressing its adjacent contact 46 into engagement with contact 50, the upper foot 76 rotated away from its adjacent contact 46 and this last mentioned contact 46 biased outward away from its adjacent contact 50 by resilient member 36. It is contemplated that, in actual operation, the switch apparatus of this invention will be actuated between the position shown in FIG. 4 and the last mentioned position opposite to that shown in FIG. 4.

Adjacent each foot 76 of each rocker member 16 is a spring detent 78, which comprises a strip of metal of sufficient thickness to give it a spring-like resiliency. Each spring detent 78 has one end 80 adapted for riveting to a tab 26 of housing 10 and another end 82 bent into a shape appropriate for engagement with the adjacent foot 76 when that foot 76 moves outward away from contact 46, the engagement being sufficiently firm to hold the appropriate rocker member 16 in this position against the resilience of member 36 exerted on the other leg 74. In FIG. 4, the lower spring detent 78 is engaging the adjacent lower foot 76 to hold rocker member 16 in the position shown with the upper contacts 46 and 50 in engagement against the resilient force of resilient member 36. Rocker member 16 will stay in this position until it is rotated to the opposite position, wherein the upper spring detent 78 will engage upper foot 76 and the lower contacts 46 and 50 will be passed into engagement.

Thus the operator is able to actuate each switch between two positions, each of which closes a separate pair of contacts. The construction of the switches is simple and comparatively inexpensive, while the housing and contact package can be shared in a multiple switch package to be produced in large quantities.

The embodiment of this invention described is a preferred embodiment only. Many equivalents will occur to those skilled in the art; and this invention should therefore be limited only by the claim which follows.

The embodiments of the invention in which an exclusive property or privilege is claimed are defined as follows:

1. In switch apparatus of the type including first and second pairs of contacts in a housing, one contact of each pair being mounted on a sheet of flexible material separated from the other contacts of each pair by resilient means disposed therebetween, the resilient means being adapted to bias both pairs of contacts into disengagement but being locally deformable to allow separate engagement of either of said pairs of contacts; the improvement comprising, in combination:

a rocker member pivotably supported in the housing and adapted for pivotal reciprocation by an external operator between first and second positions, the rocker member having a pair of legs, one of the legs being effective to engage the first pair of contacts and cause engagement thereof in the first position and to withdraw therefrom and allow disengagement thereof by the resilient means in the second position, the other leg being effective to engage the second pair of contacts and cause engagement thereof in the second position and withdraw therefrom and allow disengagement thereof by the resilient means in the first position; and a pair of spring detents in the housing, each spring detent comprising a resilient metallic strip having one end fastened to the housing and another end spaced from the housing for engagement with one of the rocker legs, one of the spring detents being adjacent each of the legs and effective, upon rotation of the rocker member to the position in which the adjacent leg is withdrawn from its associated set of contacts and the other leg is biasing the other set of contacts into engagment, to engage the adjacent leg and thus hold the rocker member in position and the other pair of contacts in engagement against the bias of the resilient means exerted on the other leg.

* * * * *

UNITED STATES PATENT AND TRADEMARK OFFICE

CERTIFICATE OF CORRECTION

PATENT NO. : 4,029,925

DATED : June 14, 1977

INVENTOR(S) : James A. Biske

It is certified that error appears in the above-identified patent and that said Letters Patent are hereby corrected as shown below:

Column 1, line 39, "whic" should read -- which --.

Column 2, line 51, "Contacting" should read -- Contact --.

Column 3, line 51, "lor" should read -- or --.

Column 4, line 20, "passed" should read -- pressed --.

Column 4, line 27, after "described" insert -- herein --.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*